US006578669B2

(12) United States Patent
Kast et al.

(10) Patent No.: US 6,578,669 B2
(45) Date of Patent: Jun. 17, 2003

(54) RAIL LUBRICATION SYSTEM

(75) Inventors: Philip J. Kast, Sun Prairie, WI (US); Raymond J. Niemczura, Sr., Mentor, OH (US); Carl A. Gedeon, Middleburg Heights, OH (US); James H. Wollbrinck, Lakewood, OH (US)

(73) Assignee: Lubriquip, Inc., Cleveland, OH (US)

( * ) Notice: Subject to any disclaimer, the term of this patent is extended or adjusted under 35 U.S.C. 154(b) by 0 days.

(21) Appl. No.: 09/844,223

(22) Filed: Apr. 27, 2001

(65) Prior Publication Data

US 2002/0157901 A1 Oct. 31, 2002

(51) Int. Cl.[7] ..... B61K 3/00
(52) U.S. Cl. ..... 184/3.2
(58) Field of Search ..... 184/3.1, 3.2

(56) References Cited

U.S. PATENT DOCUMENTS 4,726,448 A * 2/1988 Schroeder et al. ..... 184/3.2
4,930,600 A 6/1990 Kumar et al. ..... 184/3.2
5,236,063 A * 8/1993 Nelson et al. ..... 184/3.2
5,477,941 A 12/1995 Kumar et al. ..... 184/3.2
5,896,947 A 4/1999 Kumar ..... 184/3.2
6,076,637 A 6/2000 Kumar ..... 184/3.2
6,170,610 B1 1/2001 Kumar ..... 184/3.2
6,199,661 B1 3/2001 Kumar ..... 184/3.2

* cited by examiner

*Primary Examiner*—David Fenstermacher
(74) *Attorney, Agent, or Firm*—Mark Kusner; Michael A. Jaffe

(57) ABSTRACT

A lubrication system mounted on a railroad locomotive for applying a lubricant to a rail. The system is comprised of a manifold that defines a generally endless, closed lubricant path. A pump is provided to continuously convey a lubricant along the lubricant path. A reservoir for holding the lubricant defines a portion of the lubricant path. A dispensing nozzle is mounted to the locomotive above each rail for directing the lubricant onto each rail. A metering device is associated with each dispensing nozzle. Each metering device is connected to the manifold and an associated nozzle for diverting a metered amount of the lubricant from the lubricant path to the associated nozzle.

22 Claims, 4 Drawing Sheets

RAIL LUBRICATION SYSTEM

FIELD OF THE INVENTION

The present invention relates generally to lubricant applicators, and more particularly, to a locomotive-mounted lubrication system for applying a lubricant to the rails behind a moving locomotive.

BACKGROUND OF THE INVENTION

The railroad industry has realized for many years that the application of a lubricant to the rails behind a moving locomotive can reduce friction and rail and wheel wear on rail cars behind the locomotive(s). In this respect, significant reductions in train resistance and fuel consumption can result from lubrication of the rails behind the locomotive(s).

In recent years, significant advancements in lubricant technology have led to the production of special rail lubricants containing friction modifiers that produce "positive friction characteristics" wherein the coefficient of friction increases with the speed of sliding. These friction modifiers are typically solid powders or fine particulates that are suspended in relatively thick fluids. These solid materials enhance friction between a wheel and the rail to promote rolling engagement rather than sliding.

With the development of these new rail lubricants, there is a need for lubricant delivery systems that can accurately and precisely apply such lubricants to the rail behind the locomotive(s).

The present invention provides a locomotive-mounted lubrication system for accurately metering and dispensing a lubricant to the rails.

SUMMARY OF THE INVENTION

In accordance with a preferred embodiment of the present invention, there is provided a lubrication system mounted on a railroad locomotive for applying a lubricant to a rail. The system is comprised of a manifold that defines a generally endless, closed lubricant path. A pump is provided to continuously convey a lubricant along the lubricant path. A reservoir for holding the lubricant defines a portion of the lubricant path. A dispensing nozzle is mounted to the locomotive above each rail for directing the lubricant onto each rail. A metering device is associated with each dispensing nozzle. Each metering device is connected to the manifold and an associated nozzle for diverting a metered amount of the lubricant from the lubricant path to the associated nozzle.

In accordance with another aspect of the present invention, there is provided a lubrication system mounted on a railroad locomotive for applying a lubricant to a rail. The system is comprised of a lubricant circulation system operable to continuously circulate a lubricant along a generally closed path, a purge system including a tank for holding a cleaning fluid, and a metering and dispensing assembly connectable with the lubricant circulation system and with the purge system. The metering and dispensing assembly includes a dispensing nozzle mounted relative to the locomotive for directing the lubricant onto the rail, and a metering device associated with the nozzle for metering a fluid to the dispensing nozzle. A controller selectively controls connection of the metering and dispensing device to the lubrication circulation system and the purge system. The controller has a lubricant dispensing mode for connecting the metering and dispensing device to the lubricant circulation system, and a purge mode for connecting the metering and dispensing device to the purge system.

In accordance with another aspect of the present invention, there is provided a locomotive-mounted lubrication system for applying a relatively thick rail lubricant to a rail. The rail lubricant system has an air spray lubricant dispensing nozzle for spraying the rail lubricant onto the rails, and a resilient, elastomeric lubricant dispensing tip for dispensing the lubricant into an air spray.

It is an object of the present invention to provide a locomotive-mounted lubrication system for lubricating the rails behind a locomotive.

It is another object of the present invention to provide a locomotive-mounted top-of-the-rail lubrication system for lubricating the tops of rails behind a locomotive.

It is another object of the present invention to provide a lubrication system as described above for accurately and precisely dispensing a lubricant to the top of the rail.

It is another object of the present invention to provide a lubrication system as described above for dispensing a relatively thick lubricant having solid particulate in suspension therein to a rail.

A still further object of the present invention is to provide a lubrication system as described above for applying a relatively thick, thixotropic lubricant to a rail.

A still further object of the present invention is to provide a lubrication system as described above having spray heads that atomize the liquid portion of the lubricant.

A still further object of the present invention is to provide a lubrication system as described above having spray heads that are less susceptible to clogging.

A still further object of the present invention is to provide a lubrication system as described above that includes a cleaning system to reduce the likelihood of clogging of the lubrication system.

These and other objects will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF PREFERRED EMBODIMENT

Figure 1:
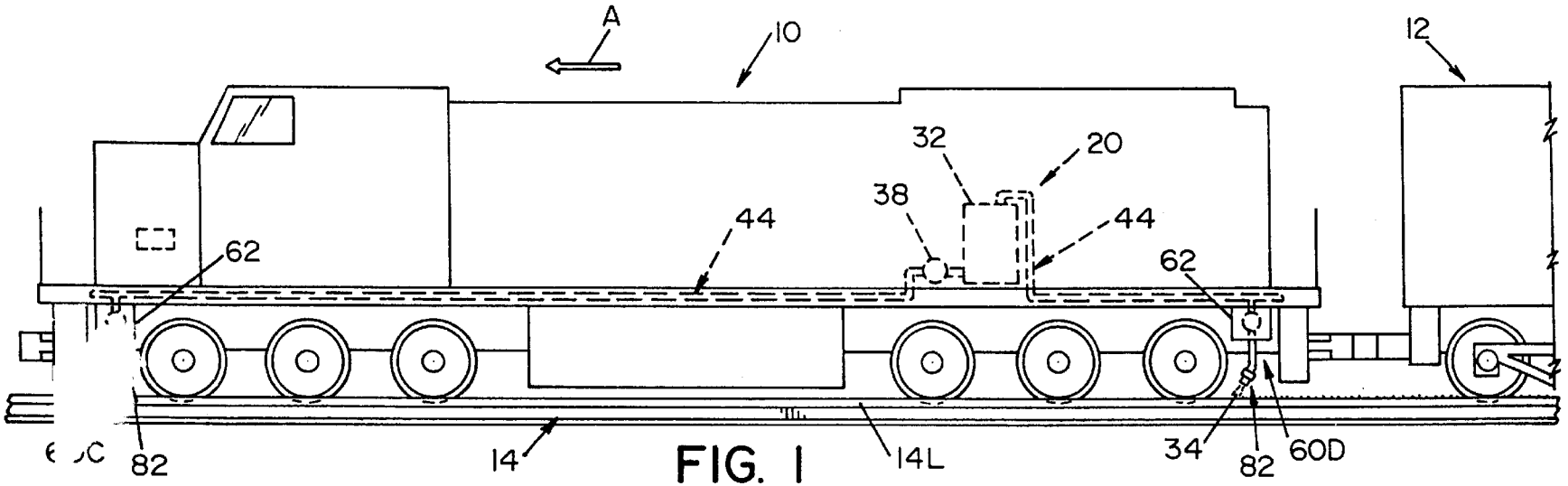
FIG. 1 is a schematic, side, elevational view of a single locomotive attached to a train, showing on the locomotive the general location of a lubrication system according to the present invention.

Referring now to the drawings wherein the showings are for the purpose of illustrating a preferred embodiment of the invention only, and not for the purpose of limiting same, FIG. 1 shows a single locomotive 10 attached to train 12 that is partially shown. A lubrication system 20 according to the present invention is schematically illustrated mounted to locomotive 10.

Figure 2:
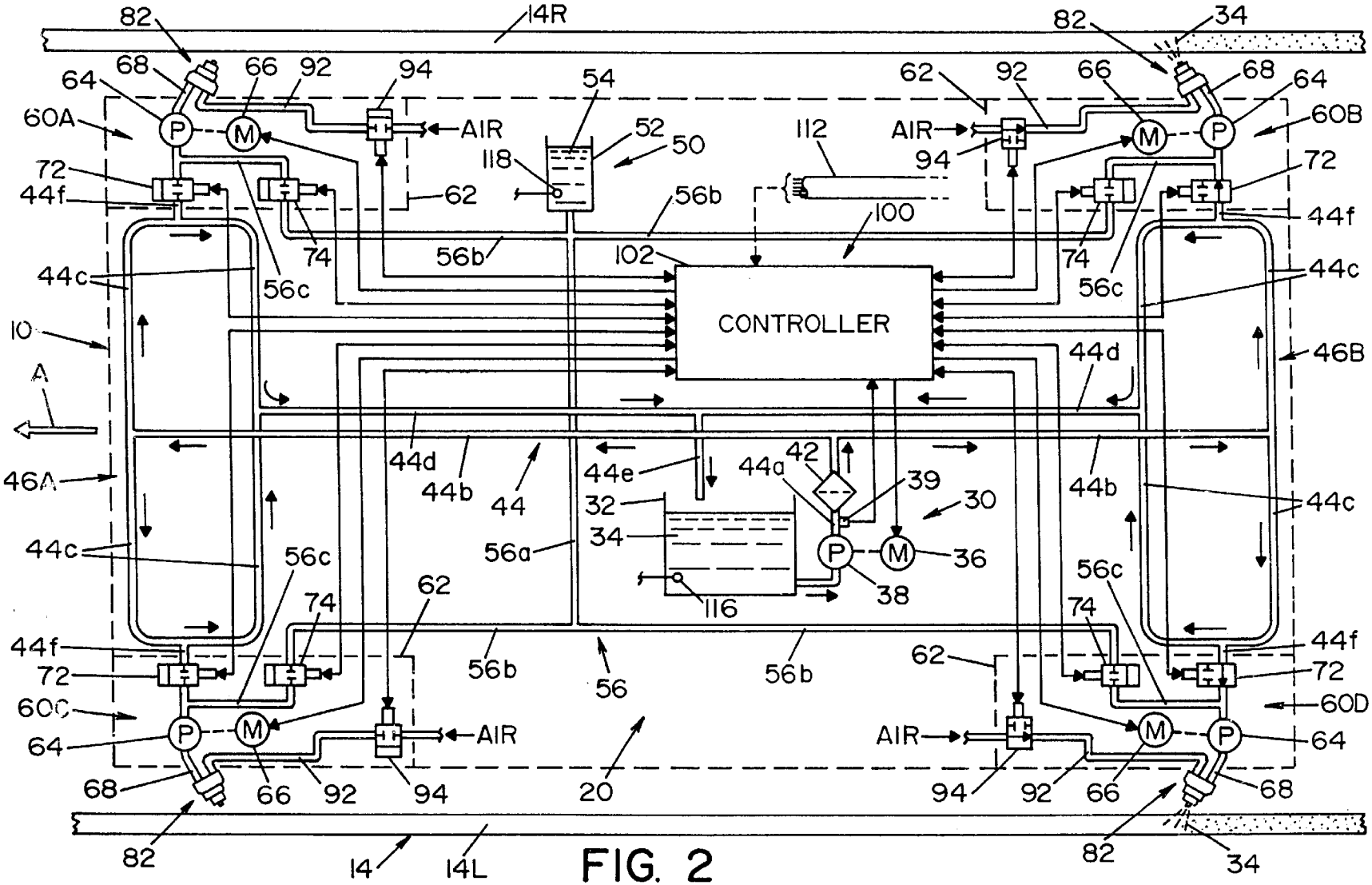
FIG. 2 is a schematic representation of a lubrication system according to the present invention.

FIG. 2 shows a schematic illustration of lubrication system 20. Lubrication system 20 is particularly applicable for dispensing a viscous lubricant, a thixotropic lubricant, a lubricant containing solid particles of powder in suspension or a lubricant that is a combination thereof. Lubrication system 20 is particularly applicable for dispensing a lubricant sold under the trade name Kelsan HPF manufactured by Kelsan Technologies Ltd. Corporation of North Vancouver, British Columbia. Kelsan HPF is a relatively thick, thixotropic lubricant having friction modifiers therein. "Friction modifiers" are powders or fine particulates that are in suspension within a lubricant. These solid materials enhance friction between a wheel and rail to promote rolling engagement rather than sliding that produces power-consuming friction, chatter, squeal and high lateral forces.

Broadly stated, lubrication system 20, as best seen in FIG. 2, is comprised of a lubricant circulation system 30, a purge system 50, a metering and dispensing system 60, comprised of individual dispensing assemblies 60A, 60B, 60C and 60D, and a control system 100.

Lubricant circulation system 30 includes a tank 32 for storing a lubricant, designated 34 in the drawings. Tank 32 is preferably located in a heated location on locomotive 10, such as the compressor room, or is externally heated by conventional heating means if located in a non-heated environment on locomotive 10. A generally closed lubricant path is defined by tubing and/or piping, designated 44 in the drawings. Piping system 44 includes a first piping section 44*a* that extends into tank 32. A motor 36 drives a pump 38 that is operatively disposed within piping section 44*a*. A filter 42 is disposed within piping section 44*a* beyond pump 38 to filter lubricant 34 entering circulation system 30. A pressure switch 39 is disposed within piping section 44*a*. Pressure switch 39 is adapted to operate upon sensing a pressure within piping system 44 that is above a normal operating pressure. Piping section 44*a* is teed into a piping section 44*b* that extends to opposite ends of locomotive 10, as schematically illustrated in FIG. 2. At the ends of locomotive 10, piping section 44*b* is connected to piping sections 44*c* that extend toward the lateral edges of locomotive 10. In FIG. 2, piping sections 44*c* are schematically illustrated as being generally U-shaped. Piping sections 44*c* rejoin to form a piping section 44*d* that extends the length of locomotive 10. A piping section 44*e* connects piping section 44*d* to tank 32.

Basically, piping system 44 defines a generally continuous, closed lubrication path through which lubricant 34 is circulated by pump 38. In the embodiment shown, two lubrication loops 46A and 46B are formed by piping system 44, one lubrication loop at each end of locomotive 10.

In accordance with one aspect of the present invention, a short piping section 44*f* connects piping section 44*c* to a metering and dispensing assembly located at one corner of locomotive 10. In the embodiment shown, four metering and dispensing assemblies, designated 60A, 60B, 60C and 60D, that shall be described in greater detail below, are shown. Each piping section 44*f* is preferably equally spaced from the location where piping section 44*b* is joined to piping sections 44*c*, for reasons that shall be addressed below when discussing the operation of the present invention.

Referring now to purge system 50, a tank 52 is provided to hold a cleaning fluid 54. A piping system 56, composed of piping sections 56*a*, 56*b* and 56*c*, provides a conduit that connects tank 52 with metering and dispensing assemblies 60A, 60B, 60C and 60D. In the embodiment shown, tank 52 is disposed on locomotive 10 to provide a gravity feed of cleaning fluid 54 to metering and dispensing assemblies 60A, 60B, 60C and 60D, via a piping system 56. As will be appreciated from a further reading of the specification, a pump and motor (not shown) may be employed to convey cleaning fluid 54 to metering and dispensing assemblies 60A, 60B, 60C and 60D. Piping system 56 includes a first piping section 56*a* that is in communication with the interior, bottom of tank 52 to receive cleaning fluid 54 therefrom. Fluid piping sections 56*b* extend from piping section 56*a* to metering and dispensing assemblies 60A, 60B, 60C and 60D.

Referring now to metering and dispensing assemblies 60A, 60B, 60C and 60D, in the embodiment shown, one metering and dispensing assembly is disposed in each corner of locomotive 10 adjacent the outermost wheels of locomotive 10. Each metering and dispensing assembly 60 is disposed above rails 14 on which locomotive 10 rides. In FIG. 2, rails 14 are designated 14R and 14L, with rail 14R referring to the right rail relative to the direction of motion of locomotive 10, and rail 14L referring to the left rail relative to the direction of motion of locomotive 10. Each metering and dispensing assembly 60A, 60B, 60C and 60D is essentially the same. Accordingly, only one shall be described in detail.

Figure 3:
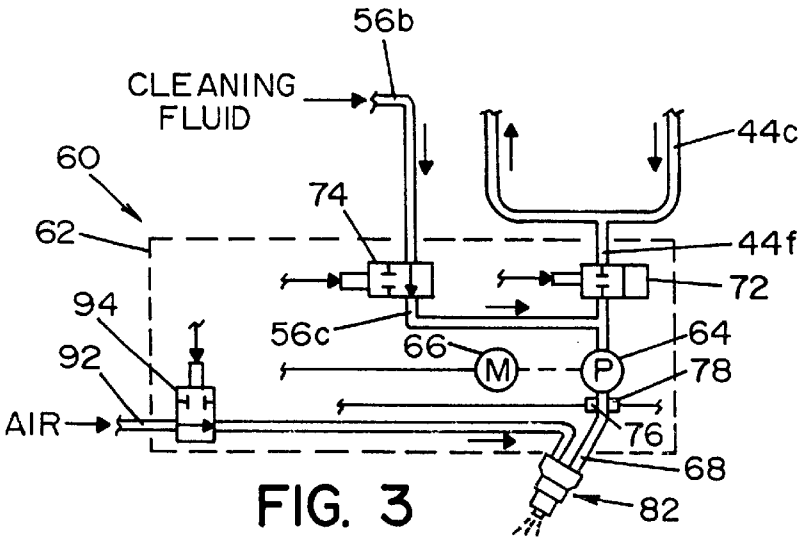
FIG. 3 is an enlarged, schematic view of a metering assembly that is part of the lubrication system shown in FIG. 2.

Most of the operative components of metering and dispensing assembly 60 are disposed within a water tight housing 62, schematically illustrated in phantom in FIGS. 2 and 3, to protect such components from the environment. Each housing 62 is preferably mounted on a suitable bulkhead of the locomotive's undercarriage at the extreme ends of locomotive 10, approximately 6–10 feet from the desired delivery point of lubricant 34. Piping section 44*f*, as heretofore described, extends into housing 62, as best seen in FIG. 3. Piping section 44*f* communicates with a metering pump 64 that is driven by a variable speed motor 66. In the embodiment shown, pump 64 is preferably a small, positive displacement gear pump, and motor 66 is preferably a stepper motor. Disposed within piping section 44*f*, between piping section 44*c* and metering pump 64, is a solenoid-controlled lubrication valve 72. In the embodiment shown, lubrication valve 72 is a two position valve, having a first closed position that obstructs the flow of lubricant 34 to metering pump 64, and a second, opened position wherein metering pump 64 is in fluid communication with piping section 44*c*.

Between lubrication valve 72 and metering pump 64, purge piping section 56*c* communicates with piping section 44*f* to be in fluid communication therewith. A solenoid-operated purge valve 74 is disposed in piping system 56 preceding metering pump 64. Purge valve 74 is a solenoid-operated valve having two operative positions. Purge valve 74 has a first closed position that obstructs the flow of cleaning fluid 54 to metering pump 64, and a second, opened position wherein metering pump 64 is in fluid communication with cleaning fluid 54 from tank 52.

From metering pump 64, a dispensing conduit 68 extends from housing 62 to a dispensing nozzle 82. Two pressure switches 76, 78 (best seen in FIG. 3) are provided within dispensing conduit 68. Pressure switch 76, referred to hereinafter as a "high pressure switch," is adapted to operate upon sensing a first, predetermined pressure that is above a normal operating pressure range for metering/dispensing assembly 60. Pressure switch 78, referred to hereinafter as a "low pressure switch," is adapted to operate upon sensing a second, predetermined pressure that is below a normal operating pressure range for metering/dispensing assembly 60. The operation of pressure switches 76, 78 shall be described in greater detail below.

An air line 92 is also connected to dispensing nozzle 82. Air line 92 is preferably connected to a source of pressurized air on locomotive 10. An air valve 94 is disposed in air line 92 before dispensing nozzle 82. Like lubrication valve 72 and purge valve 74, air valve 94 is preferably a solenoid-operated two position valve having a first off position preventing pressurized air from communicating with dispensing nozzle 82 and a second, opened position wherein pressurized air is in communication with dispensing nozzle 82.

Figure 6:
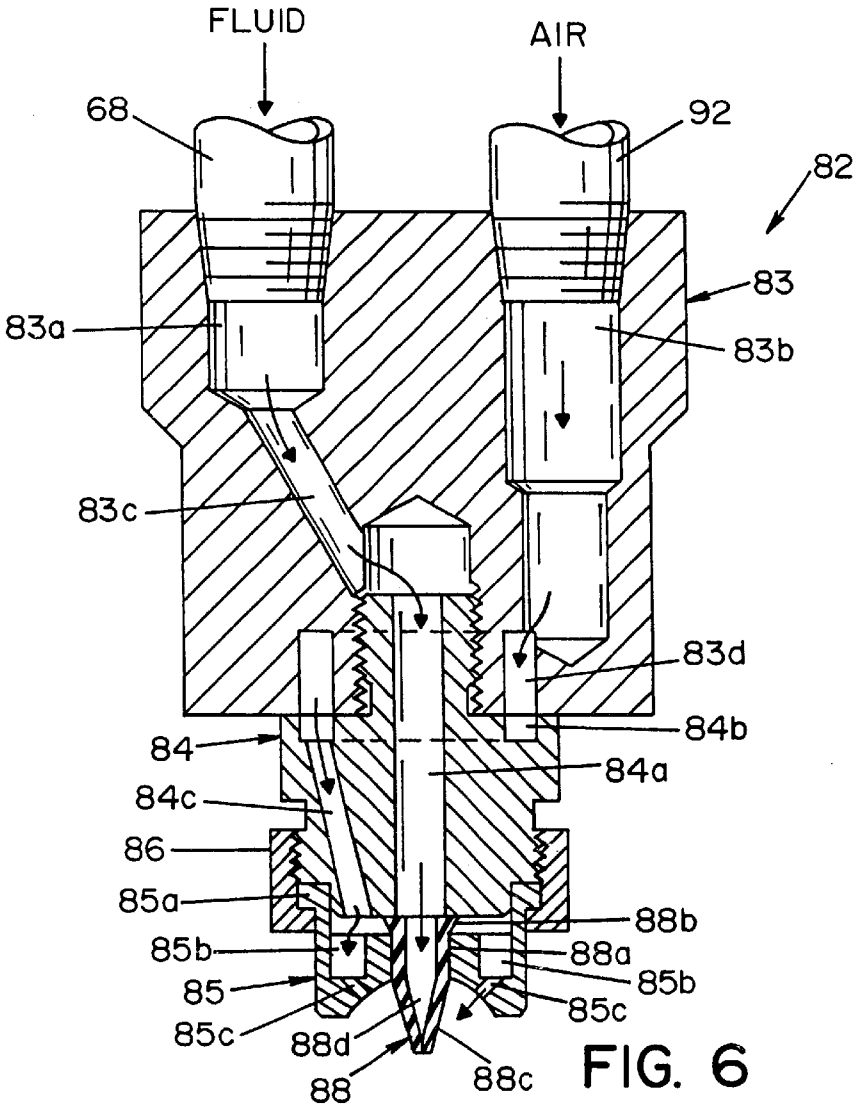
FIG. 6 is a sectional view of the dispensing nozzle shown in FIG. 5.
Figure 5:
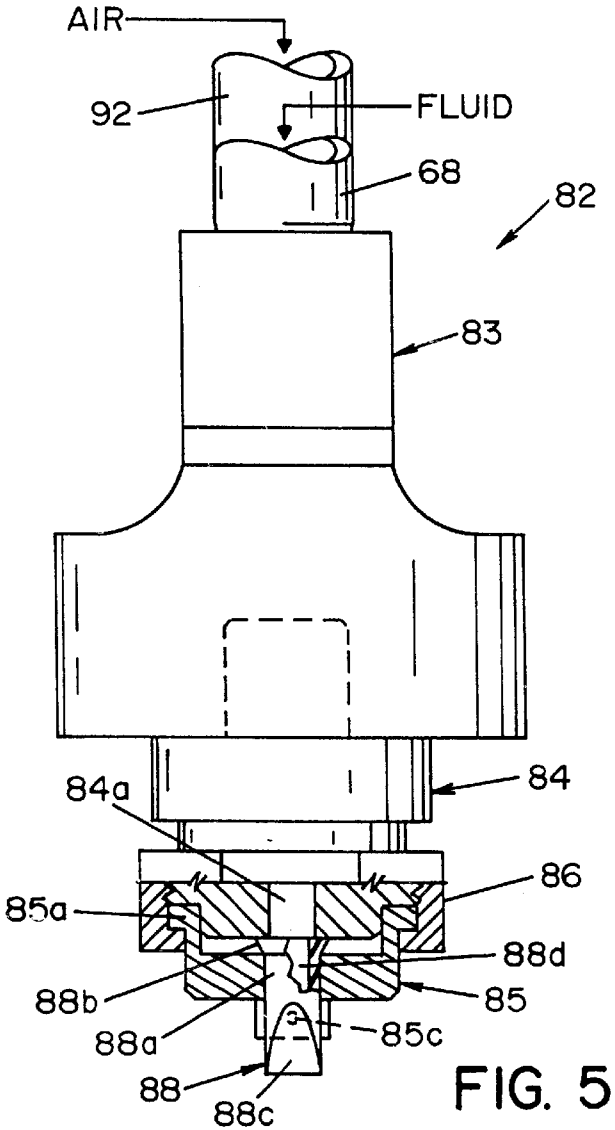
FIG. 5 is an enlarged view of a lubrication dispensing nozzle, illustrating another aspect of the present invention.

Dispensing nozzle 82 is best illustrated in FIGS. 5 and 6. In many respects, dispensing nozzle 82 is similar to a conventional, industrial paint spray nozzle. Dispensing nozzle 82 is generally comprised of a nozzle body 83, a lubricant cap 84, an air cap 85, a locking ring 86 and a lubricant tip 88. Nozzle body 83 includes conventional, tapped piping ports 83*a*, 83*b* for attachment to lubricant conduit 68 and air line 92, respectively. A passage 83*c* formed in nozzle body 83 connects lubricant port 83*a* to a central lubricant chamber 84*a* that extends through lubricant cap 84. Port 83*b* communicates with an annular chamber 83*d* in nozzle body 83 and a mating groove 84*b* in lubricant cap 84. Annular chamber 83*d* and groove 84*b* are in fluid communication with a chamber 84*c* that extends through lubricant cap 84 to the front face thereof. Air cap 85 is mounted onto lubricant cap 84 by a locking ring 86 that fits onto lubricant cap 84 in a conventional manner. Locking ring 86 captures an annular flange 85*a* on air cap 85. An annular cavity 85*b* is defined between air cap 85 and lubricant cap 84. Annular cavity 85*b* is in fluid communication with channel 84*c* in lubricant cap 84. Air spray ports 85*c* extend through air cap 85 from cavity 85*b* to a location on opposite sides of lubricant tip 88. Instead of a conventional, metal lubricant spray tip, according to one aspect of the present invention, dispensing nozzle 82 has a lubricant tip 88 formed of a resilient, elastomeric material. Lubricant tip 88 has a generally cylindrical body portion 88*a* having an annular flange 88*b*, as best seen in FIG. 6, at one end and two, tapered, flat portions, designated 88*c*, that define a "duck bill" lubricant dispensing tip, at the other end. Lubricant tip 88 is captured between air cap 85 and lubricant cap 84. Lubricant tip 88 has an inner opening 88*d* that extends therethrough and that is in fluid communication with lubricant chamber 84*a* in lubricant cap 84.

Figure 4:
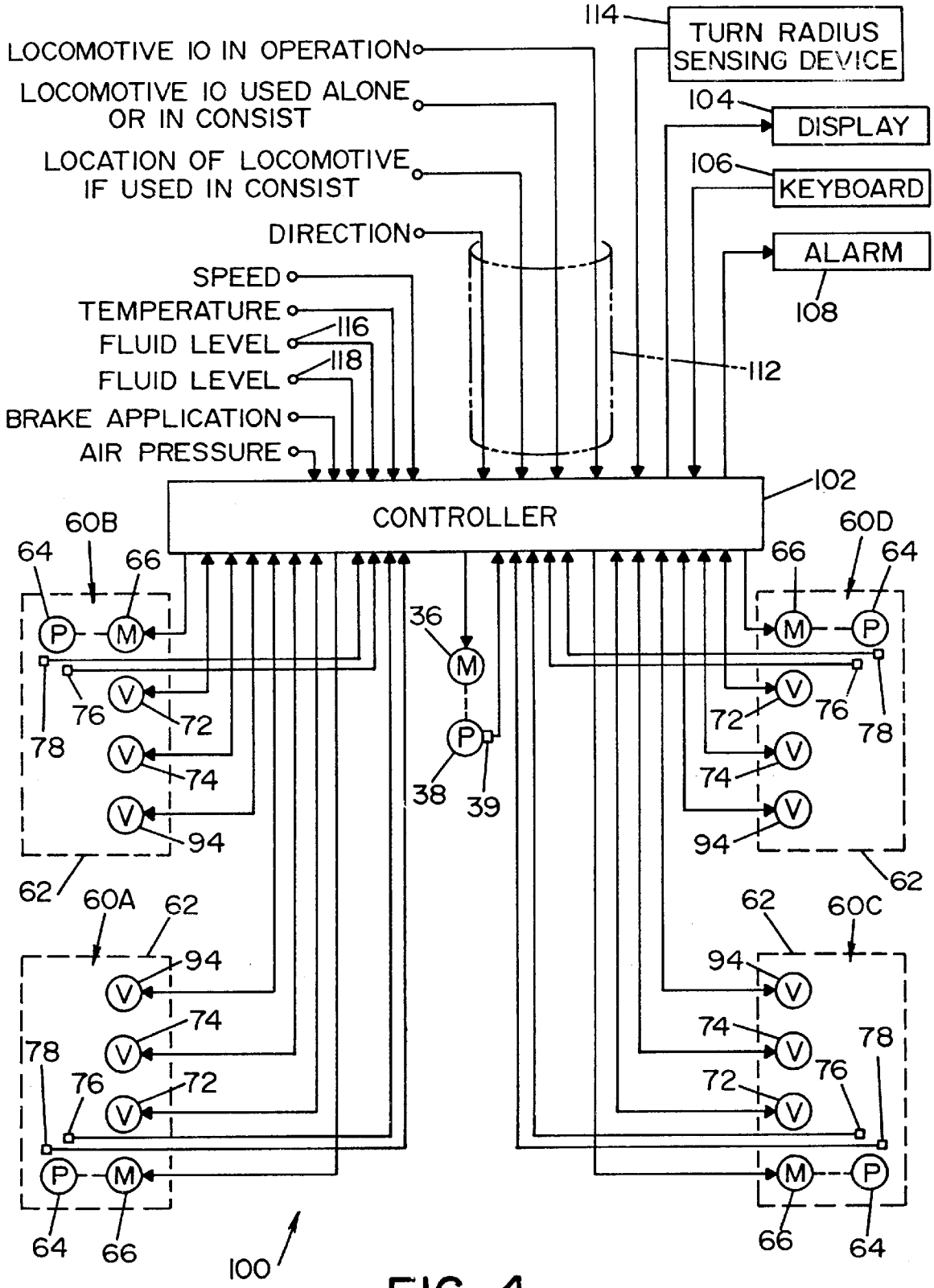
FIG. 4 is an electrical schematic view of the control system of the lubrication system shown in FIG. 2.

Referring now to FIG. 4, a block, diagrammatic representation of control system 100 is shown. The physical operations of lubrication system 20 are basically controlled by controller 102 which is programmed to control such operations based upon a program stored therein. Controller 102 may be a microprocessor or a programmable logic controller (PLC). Controller 102 operates based on information relating to the operation and characteristics of locomotive 10, as well as certain internal characteristics of lubrication system 20.

Controller 102 is connected to an electrical power source on locomotive 10 for its operating power. Controller 102 may also include an internal battery (not shown) for internal system operation during periods when locomotive 10 may not be operating. Control system 100 includes a display system 104 that provides a visual display as to the status and operation of lubrication system 20, an input panel 106 wherein an operator may interface with controller 102 and alarm(s) 108.

With respect to the characteristics and operation of locomotive 10, controller 102 is connected to a "locomotive control line" 112 that is part of a conventional locomotive 10. Control line 112 may be best described as a plurality of electrical conductors, each conductor being indicative of a function or operating characteristics of locomotive 10. These conductors, i.e., of locomotive control line 112, provide controller 102 with the following information:

- is locomotive 10 in operation;
- is locomotive 10 used alone, i.e., as a single locomotive, or is locomotive 10 one of several in a consist of locomotives;
- the location of locomotive 10 if used in a consist of locomotives;
- the direction of movement of locomotive 10.

A radar device (not shown) or other similar speed sensing device provides an indication to controller 102 of the speed of locomotive 10 on rails 14R and 14L.

Pressure transducers (not shown) disposed at select locations within the air lines of locomotive 10 provide controller 102 with the following information:

- whether the "braking" function of locomotive 10 is "on" or "off";
- the existence of air pressure in air line 92; and, A curve sensing device, designated 114 in FIG. 3, provides controller 102 with information as to whether locomotive 10 is operating on straight or curved rails. Rail curve sensing device 114 is not typically provided as standard equipment on locomotive 10. Such a "rail curve sensing device 114" is typically an add-on feature that if present on locomotive 10 would provide a signal along a separate signal line to controller 102. In the embodiment shown, controller 102 is programmed to utilize information regarding curvature of the rail in the operation of lubrication system 20. However, as will be appreciated from a further reading of the specification, lubrication system 20 finds advantageous application with or without a rail curve sensing device 114.

In addition to sensing and monitoring operations and characteristics of locomotive 10, controller 102 also receives information from sensors that monitor the operation of lubrication system 20. In this respect, lubrication tank 32 includes a fluid level sensor 116 and purge fluid tank 52 includes a fluid level sensor 118, to provide indication to controller 102 of the fluid levels in the respective tanks 32, 52. In addition, controller 102 receives operational feedback signals from lubrication valve 72, purge valve 74 and air valve 94. Pumps 38 and 64 also provide operational feedback to controller 102. Pressure switch 39 is connected to controller 102 to provide a signal thereto in the event the pressure within piping system 44 exceeds a normal operating pressure. Pressure switches 76, 78 are connected to controller 102 to provide signals thereto should the pressure within dispensing conduit 68 exceeds or is below a normal operating range.

Based upon the aforementioned sensed data, controller 102 is programmed to operate lubrication system 20 in a lubrication mode or a purge mode, as shall now be described.

The following description is based upon the understanding that locomotives may operate in two directions. As such, any lubricant deposited on the rails is deposited on the rails over which a locomotive, or the last locomotive in a consist of locomotives, has already traveled, i.e., behind the last locomotive.

In a lubrication mode, lubrication system 20 is programmed to spray a predetermined, metered amount of lubricant 34 onto rails 14R and 14L behind the last wheel of the last locomotive 10. In this respect, controller 102 is programmed to operate if locomotive 10 is operating alone or if locomotive 10 is the last locomotive in a consist of locomotives. Thus, controller 102, based upon its monitoring of electrical conductors within locomotive control lines 112, determines if locomotive 10 is operating alone or if locomotive 10 is one of several locomotives in a consist. If locomotive 10 is one of a plurality of locomotives in a consist of locomotives, controller 102 determines whether it is the last locomotive in the direction of motion of the consist. FIG. 2 shows a locomotive 10 in phantom moving to the left as indicated by arrow "A." For the purposes of the following discussion, it may be assumed that locomotive 10 is either a single locomotive, or the last locomotive in a consist of locomotives all moving in the direction indicated by arrow "A."

Once controller 102 determines that lubrication system 20 should be operational, it initiates motor 36 to cause pump 38 to circulate lubricant 34 through piping system 44. As indicated above, piping system 44 essentially defines an endless, closed path that includes tank 32. Piping system 44 enables lubricant 34 to be continuously moved. This continual movement mixes the powder and particulates within the liquid lubricant. The continual motion of the thixotropic lubricant also maintains the powder and particulates in suspension. During the operation of circulation system 30, pressure switch 39 is operable to provide a signal to controller 102 in the event the pressure in piping system 44 exceeds a normal operating pressure range, indicating an obstruction and a lack of flow of lubricant 34 in piping system 44. Controller 102 would provide an indication of the condition on display 104, and may initiate an audible or visual alarm 108.

As noted above, a lubricant such as one sold under the trade name Kelsan HPF finds advantageous application with the present invention. Kelsan HPF is a relatively thick, viscous material having a consistency similar to a thick paint. Kelsan HPF is thixotropic, meaning that it undergoes large changes in consistency, i.e., viscosity, once subjected to a shearing force. In this respect, the viscosity of the lubricant when exposed to the shearing force caused by the continual pumping drops considerably, but will generally return to its original value in the absence of the shearing force. In this respect, motor 36 and pump 38 are dimensioned to be able to convey lubricant 34 through piping system 44 while maintaining a desired operating pressure within piping system 44. As will be appreciated, the pressure within piping system 44 will vary from pump 38 to piping section 44*e*. In this respect, a pressure drop will exist from the beginning of piping system 44 to the end thereof. Moreover, the pressure within piping system 44 for a giving pump 38 varies as the temperature of lubricant 34 varies. Still further, an optimum operating pressure within piping system 44 will vary depending upon the type of lubricant used. For Kelsan HPF, it has been found that an average pressure of between 30 psi and 40 psi is preferable. Piping system 44 thus essentially defines a manifold containing a pressurized, mixed, two-phase lubricant.

In one embodiment, controller 102 is pre-programmed to initiate dispensing of lubricant 34 onto rails 14R and 14L behind locomotive 10 once locomotive 10 has attained a minimum speed. The minimum threshold speed may be a pre-programmed feature within controller 102, or may be programmable by an operator using input panel 106. Once locomotive 10 has reached the minimum threshold speed, controller 102 initiates the metered dispensing of lubricant 34 onto rails 14R, 14L behind locomotive 10. Since lubricant 34 is to be dispensed only behind locomotive 10, only metering and dispensing assemblies 60B and 60D, located at the trailing end of locomotive 10 in the embodiment shown in FIG. 2, are initiated by controller 102.

During metering and dispensing of lubricant 34, controller 102 maintains purge valve 74 in its closed position, as shown in FIG. 2 to prevent cleaning fluid 54 from tank 52 from entering into metering pump 64. Lubrication valve 72 is in its second, opened position to allow pressurized lubricant 34 in piping system 44 to be in communication with metering pump 64. The amount of lubricant 34 provided to dispensing nozzle 82 is controlled by motor 66 and metering pump 64. As indicated above, metering pump 64 is preferably a gear pump that meters a fixed amount of lubricant 34 per angular rotation. By controlling the speed of rotation of motor 66, the amount of lubricant conveyed to dispensing nozzle 82 through dispensing conduit 68 may be accurately metered and controlled. In this respect, stepper motor 66 is controllable to operate with accurate, incremental control of its rotation, and thus provides accurate and precise control of metering pump 64. As will be appreciated, metering and dispensing assemblies 60B and 60D are diverting and metering fixed amounts of moving lubricant from piping system 44.

During the operation of metering pump 64, pressure switches 76, 78 are operable to provide a signal to controller 102 in the event that the pressure within dispensing conduit 68 exceeds a normal operating pressure (pressure switch 76) or is below the normal operating pressure (pressure switch 78). In this respect, when dispensing nozzle 82 is operating properly, the pressure within dispensing conduit 68 typically falls within a certain range. Pressures above this range would be an indication of a clogged or obstructed dispensing nozzle 82, while a pressure below this range would indicate a leak, defective nozzle tip 88 or the like. In the event of either situation, one or the other of pressure switches 76, 78 would provide an error signal to controller 102 indicative of faulty operation. Controller 102 would provide an indication on display 104 of the faulty metering and dispensing assembly 60, and may initiate an audible or visual alarm 108.

Actuation of motor 66 in metering and dispensing assemblies 60B and 60D occur simultaneously with, or slightly after, actuation of air valves 94 associated with metering and dispensing assemblies 60B and 60D. Air valves 94 are moved to the open position to allow pressurized air to flow to dispensing nozzle 82. The metered lubricant 34 and air unite at dispensing nozzle 82 to produce an atomized spray that is dispensed onto rails 14R and 14L. The air pressure and air flow provided by air line 92 is preferably controlled by means (not shown) to be within the design operating parameters of the dispensing nozzle 82. Dispensing nozzles 82 are preferably mounted on locomotive 10 to be directly above rails 14R and 14L at a distance wherein dispensing nozzle 82 is about 3 inches therefrom, so as to direct a spray of lubricant 34 onto rails 14R and 14L with little or no lateral over spray.

Controller 102 is preferably programmed to provide a continuous spray of lubricant at a predetermined, desired rate to deposit a specific, nearly constant, amount of lubricant onto rails 14R, 14L regardless of the speed of locomotive 10. To this end, controller 102 monitors the speed of locomotive 10 and adjusts the operational speed of motor 66 and thus the metering, i.e., dispensing, of lubricant 34 in accordance therewith. More specifically, as the speed of locomotive 10 increases, controller 102 causes the speed of motor 66 in metering and dispensing assemblies 60B and 60D to increase to cause more lubricant 34 to be pumped, i.e., metered, to dispensing nozzles 82, thereby increasing the amount of lubricant sprayed in proportion to the speed of locomotive 10 so as to maintain a nearly constant deposition rate of lubricant 34 on rails 14R and 14L. As the speed of locomotive 10 decreases, controller 102 decreases the speed of motor 66 to decrease the amount of lubricant metered to dispensing nozzle 82 to spray a lesser amount of lubricant 34 onto rails 14R and 14L. The result is to maintain a nearly uniform application of lubricant 34 along rails 14R and 14L irrespective of the speed of locomotive 10.

As indicated above, controller 102 also monitors and detects a curvature of the rails by sensing a signal from rail curve sensing device 114. Along a curve, the outer rail spans a greater distance and is therefore longer in length than the inner rail. In such situations, lubricant 34 is preferably applied in accordance with recommendations of a lubricant manufacturer. In the case of Kelsan HPF, the manufacturer recommends that the rate of application of lubricant 34 on the inner rail be maintained at the same rate of deposition as along straight rails, but that the rate of application of lubricant 34 on the outer rail be reduced. To this end, controller 102 is programmed to control the speed of motor 66 of the inner metering and dispensing assembly 60 so as to maintain the output of metering pump 64 on the inner rail. In other words, the speed of motor 66 of the inner metering and dispensing assembly 60 is controlled to maintain the uniform application of lubricant 34 to the inner rail. The outer metering and dispensing assembly 60 is controlled so as to reduce the deposition rate of lubricant 34 on the outer rail. The amount of increase or decrease in the dispensing of lubricant 34 is also based upon the radius of curvature of the rails as well as the speed of locomotive 10 at that time. As will be appreciated by those skilled in the art, the amount of lubricant 34 dispensed to the outer and inner rails may be adjusted by controller 12 to control lateral forces, and/or to optimize the effect of lubricant 34 in a curve.

The metering of lubricant 34 from piping system 44 via metering pump 64 to dispensing nozzle 82 is maintained continuously as long as locomotive 10 is in its motive state and exceeds the aforementioned minimum threshold speed. When the speed of locomotive 10 falls below the aforementioned minimum threshold speed, or during "braking" of locomotive 10, lubrication of rails 14R, 14L is preferably stopped. In this respect, when controller 102 senses a speed below some desired "shut-off" speed or when controller 102 senses that locomotive 10 is in a braking mode, controller 102 is programmed to cease lubrication of rails 14R and 14L. Controller 102 stops motor 66 from any further pumping, i.e., metering, of lubricant 34 to dispensing nozzle 82. In one respect, it has been found that use of stepper motors 66 to drive metering pumps 64 provides a positive stop to dispensing any additional lubricant 34 in that stepper motors 66 maintain their position when stopped and do not allow further rotation of metering pumps 64 which prevents further lubrication from being dispensed to dispensing nozzle 82. In one embodiment, in addition to stopping stepper motors 66, controller 102 may also move lubrication valves 72 to their first, closed positions, to prevent pressurized lubricant 34 in piping system 44 from being in communication with metering pumps 64.

Air valves 94 are allowed to remain in their open position for a short, predetermined period of time following cessation of operation of metering pumps 64. This short period of time allows the pressurized air from air valves 94 to "blow-out" any residual lubricant 34 that may be on the dispensing nozzles 82 or on external surfaces of air ports 85*c*. After such a short period of time, controller 102 causes air valves 94 to shift to their closed positions, thereby shutting off air to dispensing nozzles 82. With the flow of lubricant 34 and the air cut-off, lubricant 34 is no longer sprayed onto rails 14R and 14L. As a result, the wheels of the rail cars following locomotive 10 roll over onto non-lubricated track. The non-lubricated track increases the friction between the rail car wheels and the rails to assist braking and the slowing of the train.

Lubrication system 20 has heretofore been described with respect to its rail lubrication functions. In accordance with another aspect of the present invention, lubrication system 20 includes a purge or cleaning mode to insure proper operation of metering and dispensing assemblies 60A, 60B, 60C and 60D after prolonged periods of inactivity and/or nonuse. In this respect, as indicated above, the proposed lubrication system 20 is intended for use with viscous lubricants, thixotropic lubricants, lubricants having solid particulates or powders in suspension, or combinations thereof. Such lubricants may tend to gel and coat, i.e., dry, on dispensing nozzle 82. To prevent clogging of dispensing nozzle 82, lubrication system 20 includes the aforementioned purge system 50. A purge cycle is initiated by controller 102 after long periods of inactivity of lubrication system 20. Such periods of inactivity may be the result of the inactivity of locomotive 10 or may result from locomotive 10 being the first or middle locomotive in a consist of locomotives. In either situation, lubrication system 20 may remain inactive for long periods of time. Controller 102 is programmed to monitor the periods of inactivity and to run a purge cycle prior to a lubrication cycle.

During a purge cycle, controller 102 causes lubrication valve 72 to move to its first, closed position thereby preventing lubricant 34 from piping system 44 from entering metering pump 64. Controller 102 then causes purge valve 74 to move to its second, opened position allowing cleaning fluid 54 from tank 52 to be in fluid communication with metering pump 64. As indicated above in the embodiment shown, tank 52 is disposed at a location on locomotive 10 to produce a gravity feed of cleaning fluid 54 to metering pump 64. With cleaning fluid 54 available to metering pump 64, controller 102 causes motor 66 to start at a specific speed for a predetermined period of time to pump a predetermined amount of cleaning fluid 54 through dispensing nozzle 82. Controller 102 may open air valve 94 to allow pressurized air to dispensing nozzle 82. Air valve 94 may be operated to provide a continuous airflow to dispensing nozzle 82, or may be cyclically operated to provide pulses of air to dispensing nozzle 82. Cleaning fluid 54 is pumped and/or sprayed through dispensing nozzle 82 to remove any residual, caked-on lubricant 34 that may have remained on lubricant tip 88 and that may adversely affect a desired lubrication spray pattern of dispensing nozzle 82. The use of a resilient, elastomeric lubricant tip 88 also deters adhesion and coating of lubricant 34 thereon. The flexibility of lubricant tip 88 also makes removal of any caked-on or coated lubricant 34 easily removed by the purging of air and cleaning fluid 54 through lubricant tip 88.

In a preferred embodiment of the present invention, propylene glycol is used as a cleaning fluid 54. In addition, other non-toxic and environmentally compatible solutions such as, mixtures containing propylene glycol or other glycols may be used as cleaning fluid 54 and find advantageous application in purging lubrication system 20.

After a predetermined amount of cleaning fluid 54 has been pumped by metering pump 64 through dispensing nozzle 82, controller 102 stops motor 66 that drives metering pump 64, and after a short period of time, closes air valve 94, if operating. The purge system 50 thus purges metering pump 64 and dispensing nozzle 82 of any residual, dried, caked-on lubricant 34 that may remain on lubricant tip 88.

It will, of course, be appreciated that the times and situations for purging lubrication system 20 may vary from operator to operator. Controller 102 may be programmed to meet specific requirements and guidelines set by a rail operator. In this respect, controller 102 may be programmed to include a cycle that can be initiated by an operator using input panel 106.

As indicated above, part of lubrication system 20 includes fluid level sensors 116 and 118 that are disposed in tanks 32 and 52, respectively. Controller 102 is operable to monitor outputs from sensors 116, 118 and provide either a visual or audible signal to the rail operator in the event that the level of lubricant 34 or cleaning fluid 54 falls below a desired level.

The present invention thus provides a lubrication system 20 for use with newer, developed rail lubricants. The present invention is particularly applicable to relatively thick, viscous lubricants, thixotropic lubricants, lubricants having particles or powders suspended therein, or combinations thereof. Circulation system 30 provides a continuously moving reservoir of lubricant 34 that is accessible to the metering and dispensing assemblies 60A, 60B, 60C and 60D. By maintaining such lubricants in motion, metering and dispensing of lubricants in an accurate and precise fashion is facilitated. Further, lubrication system 20 includes a purge system 50 to maintain proper operation and performance of dispensing nozzles 82 that apply lubricant 34 to rails 14R and 14L.

The foregoing description is a specific embodiment of the present invention. It should be appreciated that this embodiment is described for purposes of illustration only, and that numerous alterations and modifications may be practiced by those skilled in the art without departing from the spirit and scope of the invention. For example, although lubrication system 20 has been described with respect to a top-of-the-rail system, the present invention may also find advantageous application in dispensing lubricant to a rail gage side and/or wheel flanges. It is intended that all such modifications and alterations be included insofar as they come within the scope of the invention as claimed or the equivalents thereof.

Having described the invention, the following is claimed:

1. A lubrication system mounted on a railroad locomotive for applying a lubricant to a rail, said system comprised of:

a manifold defining a generally continuous, endless, closed lubricant path;

a reservoir for holding a lubricant, said reservoir defining a portion of said lubricant path;

a circulation pump that is operable during operation of the lubrication system to continuously convey said lubricant from said reservoir, through said manifold and back to said reservoir;

a dispensing nozzle mountable to said locomotive above said rail for directing said lubricant onto said rail; and a metering device associated with said dispensing nozzle, said metering device connected to said manifold and said associated nozzle for diverting a metered amount of said lubricant that is being circulated through said manifold from said lubricant path to said associated nozzle.

2. A lubrication system as defined in claim 1, further comprising a controller for controlling operation of said pump and said metering device.

3. A lubrication system as defined in claim 2, wherein said metering device is controllable for continuous operation to continually divert lubricant from said lubricant path to said nozzle during a lubrication mode.

4. A lubrication system as defined in claim 3, wherein said metering device is comprised of a gear pump that is driven by a drive motor.

5. A lubrication system as defined in claim 4, wherein said drive motor is a stepper motor.

6. A lubrication system as defined in claim 4, wherein said controller is connectable to a locomotive control circuit, and wherein said controller operates in response thereto.

7. A lubrication system as defined in claim 4, wherein said lubrication system is for applying lubricant to the top of said rail.

8. A lubrication system as defined in claim 2, further comprising a source of pressurized air connectable to said dispensing nozzle to dispense said lubricant as an atomized spray.

9. A lubrication system as defined in claim 7, wherein said communication between said source of pressurized air with said dispensing nozzle is controlled by a valve.

10. A lubrication system as defined in claim 2, further comprising a purge system for purging said metering device and said nozzle of said lubricant, said purge system including:

a purge tank for holding a purge fluid; and a fluid conduit connected to said purge tank and connectable to said metering device for conveying purge fluid from said purge tank to said metering device.

11. A lubrication system as defined in claim 10, further comprising a control valve means disposed in fluid communication with and between said manifold and said metering device disposed and in fluid communication with and between said pump and said metering device, said control valve means for controlling the flow of said lubricant and said purge fluid to said metering device and having a first condition connecting said metering device to said manifold and a second condition connecting said metering device to said purge system.

12. A lubrication system as defined in claim 11, wherein said control valve means is comprised of a lubricant control valve for controlling the flow of lubricant to said metering device, and a purge control valve for controlling the flow of purge fluid to said metering device, said lubricant valve and said purge valve being controlled by said controller.

13. A lubrication system as defined in claim 12, wherein said lubricant valve and said purge valve are two-position, solenoid controlled valves.

14. A lubrication system as defined in claim 13, wherein said controller is a programmable logic controller.

15. A lubrication system as defined in claim 13, wherein said controller is a microprocessor.

16. A lubrication system as defined in claim 3, wherein said dispensing nozzle includes a dispensing tip formed of resilient, elastomeric material.

17. A lubrication system mounted on a railroad locomotive for applying a lubricant to a rail, said system comprised of:

a lubricant circulation system operable to continuously circulate a lubricant along a generally continuous, endless, closed path;

a purge system including a tank for holding a cleaning fluid;

a metering and dispensing assembly connectable with said lubricant circulation system and with said purge system, said metering and dispensing assembly including:

a dispensing nozzle mounted relative to said locomotive for directing said lubricant onto said rail, a metering device associated with said nozzle for metering a fluid to said dispensing nozzle, and a controller for selectively controlling connection of said metering and dispensing device to said lubrication circulation system and said purge system, said controller having a lubricant dispensing mode for connecting said metering and dispensing device to said lubricant circulation system, and a purge mode for connecting said metering and dispensing device to said purge system.

18. A lubrication system as defined in claim 17, wherein said lubricant circulation system is comprised of piping that forms a circuitous path that includes a tank for holding said lubricant, said metering and dispensing assembly being connectable to said piping.

19. A lubrication system as defined in claim 18, wherein said controller is connectable to a locomotive control circuit and is operable in response to sensed operational conditions of said locomotive based upon an inputted program.

20. A lubrication system as defined in claim 19, wherein said metering and dispensing assembly is further connectable to a source of pressurized air, wherein pressurized air is connectable to said dispensing nozzle to mix with said lubricant to produce an aerosol spray of lubricant.

21. A lubrication system as defined in claim 20, wherein said metering device is comprised of a gear pump driven by a stepper motor, said stepper motor controlled by said controller.

22. A lubrication system as defined in claim 21, further comprising control valve means disposed between said metering device and said lubricant circulation system and said purge system, and between said source of pressurized air and said dispensing nozzle, operation of said valve means being controlled by said controller.

* * * * *